US006780061B1

(12) United States Patent
Gibboney

(10) Patent No.: US 6,780,061 B1
(45) Date of Patent: Aug. 24, 2004

(54) MULTI-FUSABLE ELECTRICAL RECEPTACLE

(76) Inventor: James W. Gibboney, 3910 Dial Mill Rd., Conyers, GA (US) 30208

( * ) Notice: Subject to any disclaimer, the term of this patent is extended or adjusted under 35 U.S.C. 154(b) by 0 days.

(21) Appl. No.: 10/374,153

(22) Filed: Feb. 25, 2003

(51) Int. Cl.[7] ..... H01R 13/68; H01R 33/95
(52) U.S. Cl. ..... 439/621; 439/622
(58) Field of Search ..... 439/620–622, 439/250, 366, 509, 698, 830

(56) References Cited

U.S. PATENT DOCUMENTS 2,988,617 A * 6/1961 Grazioski ..... 337/197
4,606,590 A * 8/1986 Kauffmann et al. ..... 439/218
5,249,985 A * 10/1993 Obenauer ..... 439/621
5,482,478 A * 1/1996 Liao ..... 439/622
5,938,477 A * 8/1999 Yen ..... 439/622
5,984,730 A * 11/1999 Lu ..... 439/622
6,132,257 A * 10/2000 Wang et al. ..... 439/622

* cited by examiner

*Primary Examiner*—Michael C. Zarroli
(74) *Attorney, Agent, or Firm*—Michael A. Mann; Nexsen Pruet Adams Kleemeier, LLC

(57) ABSTRACT

A multi-fusable electrical receptacle includes a power section telescopically received within a fuse section. The receptacle may receive fuses of different sizes and ratings for different applications such as for use with a string of holiday lights and as part of an extension cord. The power section holds two wires at the bottoms of two channels. The fuse section includes two fuse holders in separate channels, each with a spring contact. When the power section and fuse section are slid together, two fuses or a single fuse and a buss bar held by the fuse holders run from the channels of the fuse section to the channels of the power section thereby forming two separate electrical paths from wires to the spring contacts. A cavity formed in the power section is dimensioned to receive the two wires folded double for better pull strength. The cavity is covered by a locking lid so that the entire receptacle housing, when the fuse section is secured to the power section, is water-tight.

18 Claims, 3 Drawing Sheets

MULTI-FUSABLE ELECTRICAL RECEPTACLE

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable

BACKGROUND OF THE INVENTION

Electrical current for household, office and industrial use is often delivered via electrical wiring to a receptacle. The electrical current can be delivered in turn to an electrical loaded by inserting an electrical plug connected to the load into the electrical receptacle. The plug has current-carrying prongs that, when inserted into corresponding holes in the receptacle, make electrical contact with internal electrical terminals.

Receptacles may be wall-mounted, or attached to the end of an extension cord or to the end of a string of holiday lights in order to provide a way to deliver electrical current to the next string of lights or another electrical load.

In older homes the wall receptacles are not made with regard to the polarity of the electrical current; that is, they are not physically arranged to receive plugs in only one orientation so that the polarity of the electrical current is maintained when transferred from the receptacle to the plug of an extension cord, and, thence, to the load. In newer homes in the United States, wall receptacles have one hole that is larger than the other to receive the neutral prong of the plug and another that is smaller for the line prong of the plug.

In some household electrical applications, fuses are used to limit the current of the load, particularly in holiday light strings. However, there remains a need for better and safer receptacles.

SUMMARY OF THE INVENTION

The present invention is a multi-fusable receptacle; that is, it is a receptacle that can receive different fuses that can be safely replaced or exchanged by the user as required.

The present receptacle includes various features that enhance safety. For example, the receptacle has a fuse for both line and neutral leads to protect a user when the receptacle is connected to an electrical source where the polarity of the electrical current is unknown. The construction of the present receptacle also reveals a number of safety features. When the two sides of the receptacle are separated, power can no longer flow through the receptacle. In another example, the design of the present receptacle and the way in which it is connected to the power lines helps to prevent a live wire from being pulled from the receptacle. Also, the AC terminals are deeply recessed in narrow channels so that, if the receptacle is opened to replace a fuse, contact with a live electrical conductor by the user is precluded.

The fuse holder is designed to accommodate two different fuse sizes so that the present receptacle can be used in different applications without modification. Furthermore, the overall length of the fuse holder with the fuse remains the same regardless of the type of fuse so no internal adjustment is required to accommodate shorter fuses.

These and other features and their advantages will become apparent to those skilled in the art of electrical appliance design from a careful reading of the Detailed Description of Preferred Embodiments, accompanied by the following Drawings.

BRIEF DESCRIPTION OF PREFERRED EMBODIMENTS

DETAILED DESCRIPTION OF PREFERRED EMBODIMENTS

The present invention is a receptacle for use on the end of a Light string or extension cord. It is designed to receive electrical power from typical insulated wire conductors connected to an electrical power source and convey it to a pair of prongs of an electrical plug when such a plug is inserted into the corresponding holes of the receptacle.

Figure 1:
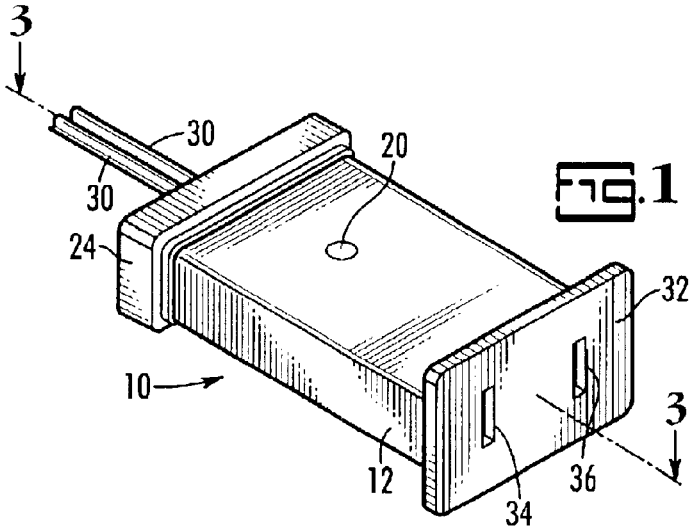
FIG. 1 is a perspective view of a receptacle according to a preferred embodiment of the present invention.
Figure 2:
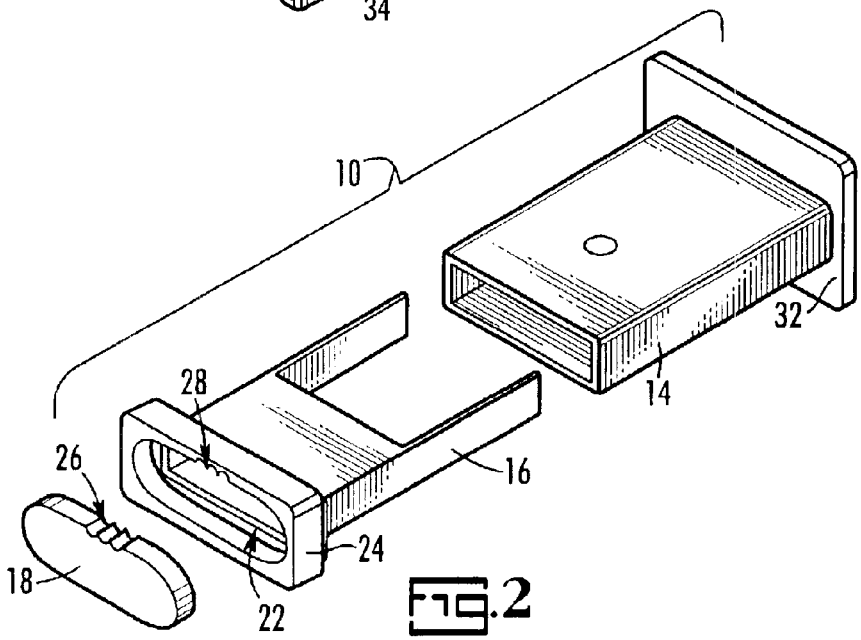
FIG. 2 is a perspective view of the receptacle of FIG. 1 with the three main parts separated, according to a preferred embodiment of the present invention.

The present receptacle, generally indicated by reference number 10, is illustrated in FIGS. 1 and 2 in perspective. FIG. 1 shows receptacle 10 from the exterior, assembled, with the first, or plug-receiving end, toward the viewer. FIG. 2 illustrates receptacle 10 partially disassembled with the second, or wire end, toward the viewer. Receptacle 10 includes a housing 12 with three major parts. Housing 12 has a fuse section 14, a power section 16, and a locking lid 18. Fuse section 14 and power section 16 fit together, preferably by telescopically sliding one into the other, and most preferably by sliding power section 16 into fuse section 14. When slid together completely, a small locking screw 20 is used to hold fuse section 14 to power section 16.

Locking lid 18 is preferably carried by power section 16 over a cavity 22 formed in the face plate 24 of power section 16, and fastened or adhered so that it cannot be removed. Small cutout portions 26 are formed in locking lid 18 and corresponding cutout portions 28 are formed in face plate 24. When locking lid 18 is inserted into cavity 22 in such a way that cutout portions 26 and 28 align, they define holes through which electrical wire conductors 30 may pass. Cavity 22 is dimensioned so that, when locking lid 18 is in place, sufficient room is left behind locking lid 18 inside housing 12 to accommodate wires 30, which are a size corresponding to 14 AWG (American Wire Gauge), bent double, in order to assure good pull strength. The holes defined by aligned cutout portions 26 and 28, are dimensioned to be undersized relative to the wire diameters and therefore "choke" wires 30 passing therethrough to help hold wires 30 in place and to make housing 12 water-tight.

Fuse section 14 also has a face plate 32 with two holes 34 and 36. Hole 36 is made to be larger than hole 34 in order to receive the larger, neutral prong of a polarized plug (see FIG. 3). However, both holes 34 and 36 also can receive the prongs of an unpolarized plug. Preferably, face plate 32 is large enough to block the ground prong of a three-prong plug, thereby preventing connection of such a plug to the present receptacle 10.

It will be apparent that the illustrations in FIGS. 1 and 2 show that receptacle 10 is intended for two prong plug configurations common in the United States and that only minor adjustments would be required in the configuration of receptacle 10 in order to accommodate plugs standard to other countries.

Figure 3:
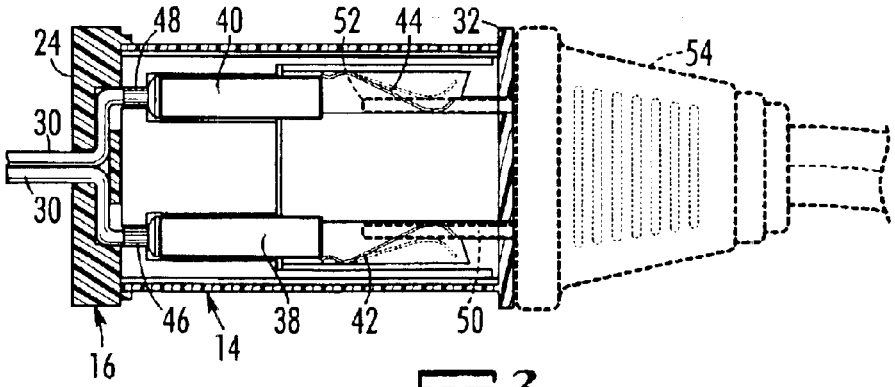
FIG. 3 is a top view of the present receptacle taken along lines 3—3 of FIG. 1, according to a preferred embodiment of the present invention.
Figure 4:
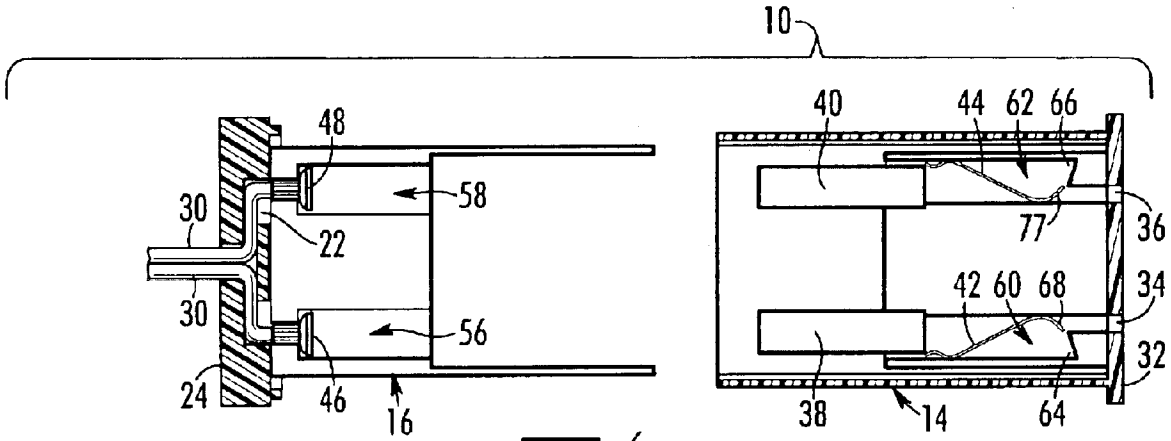
FIG. 4 is a top view of the receptacle of FIG. 3, with the two sections separated.
Figure 5:
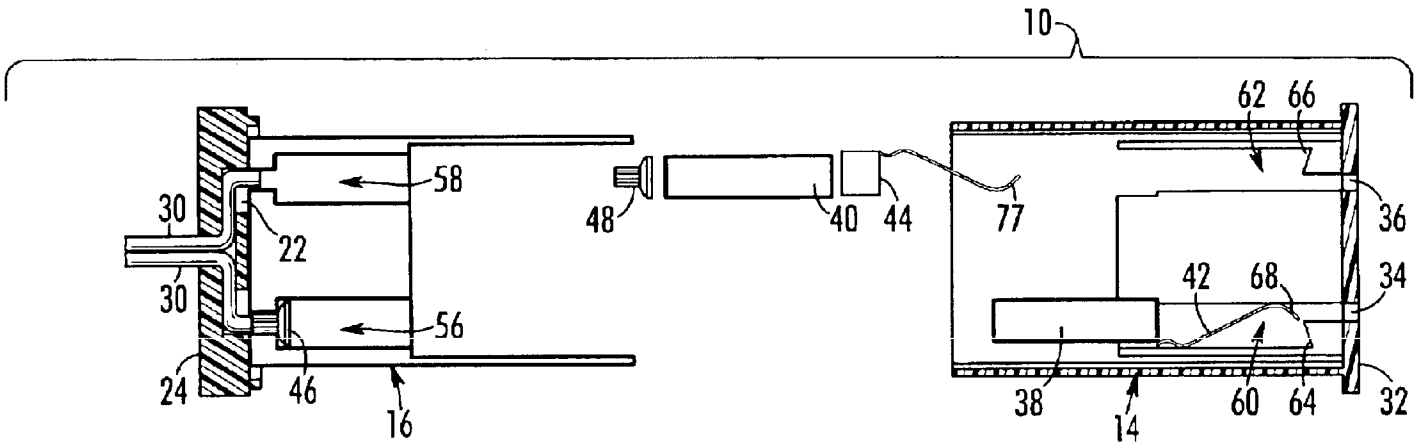
FIG. 5 is a top view of the present receptacle of FIG. 3 with one of the wires being prepared for installation and one of the fuses being inserted.
Figure 6:
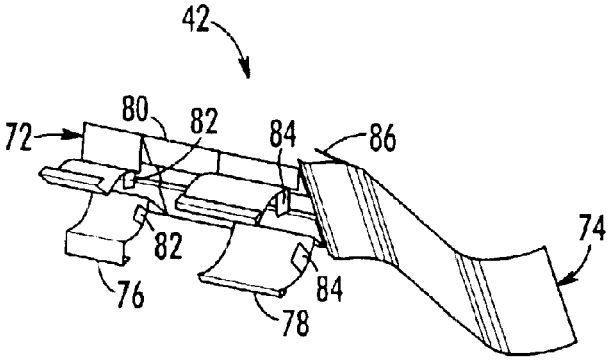
FIG. 6 is a perspective view of a fuse holder according to a preferred embodiment of the present invention.

FIGS. 3, 4 and 5 illustrate various aspects of the interior of receptacle 10. Within receptacle 10 are six parts: a pair of fuses 38, 40; a pair of fuse holders 42, 44 (or alternatively, a fuse and a buss bar); and a pair of wire terminals 46, 48 for providing electrical contact with fuses 38, 40. These components fit within channels formed inside of housing 12. Electrical current passes from wires 30 through wire terminals 46, 48, through fuses 38, 40, and then through fuse holders 42, 44 and finally to the prongs 50, 52 of plug 54 (shown in phantom lines in FIG. 3) in two electrically isolated, electrically conducting paths. One path runs from one wire of wires 30 through terminal 46, fuse 38, and fuse holder 42 and its spring contact to prong 50 of plug 54; and the other path runs from the remaining wire of wires 30 through terminal 48, fuse 40, and fuse holder 44 and its spring contact to prong 52 of plug 54.

Two fuses are preferred in order to limit current on both the neutral side and the line side in the event a non-polarized device is plugged into receptacle 10 or the polarity of the power source is unknown. In applications where a buss bar is substituted for one of the fuses, an electrical conductor is simply substituted for fuse 40.

FIG. 4 illustrates receptacle 10 when fuse section 14 and power section 16 are separated. Here, power is no longer able to flow from terminals 46, 48 to fuses 38, 40, because fuses 38, 40 act as power switches, disconnecting the input side of receptacle 10 from the output side and interrupting the electrical flow paths as soon as separation of the sections occurs. Note also that fuses 38 and 40 remain with fuse holder and that wire terminals 46 and 48 are located deep within two channels 56, 58 that are dimensioned to be narrow enough to protect the user in the event terminals 46, 48, are carrying electrical current but large enough to easily receive fuses 38, 40 when power section 16 and fuse section 14 are slid together or separated. Fuses 38, 40, however, are within reach of the end of fuse section 14 and can be pulled free by user for replacement. Once replaced, power section 16 can be slid back into fuse section 14 and the two secured together with locking screw 20.

FIG. 5 illustrates the assembly process for receptacle 10. Before locking lid 18 is installed, wires 30 are pushed through cavity 22 past channels 56, 58 so that terminals 46, 48 can be applied and crimped to wires 30. Then wires 30 can be pulled back deep into channels 56, 58, which are shaped to hold wires 30 securely in place, and cover place 18 inserted. At fuse section 14, fuses 38 and 40 can be inserted into fuse holders 42, 44, and the latter inserted into channels 60, 62. Then, as indicated before, power section 16 can be inserted into fuse section 14 and the two secured using screw 20. When receptacle 10 is assembled, fuses 38, 40, extend into both sets of channels: channels 56, 58 of power section 16 and channels 60, 62 of fuse section 14. The simplified construction of receptacle 10 results in a substantially shortened assembly time. Receptacle 10 requires approximately 20 seconds to assemble compared to more than one minute for conventional receptacles.

Fuse holders 42, 44, are formed to hold fuses 38, 40 and to provide spring contact with prongs 50, 52. Fuse holders 42, 44, are made of a material that has good electrical conductivity and sufficient resilience, or "memory," to serve both functions of holding fuses 38, 40 and maintaining engagement with prongs 50, 52. Steel, steel alloys, copper, copper alloys and many other materials can serve this function well.

Fuse holders 42, 44, are formed so that, as prongs 50, 52 are inserted into fuse section 14 (see FIG. 3), prongs 50, 52, cam the fuse holders 42, 44, to the side. Channels 60, 62 are preferably formed to receive the fuse holders 42, 44 in the cammed position, such as by providing notches 64, 66 for receiving cammed ends 68, 70, of fuse holders 42, 44.

FIGS. 6 and 7A, 7B, and 7C illustrate further details of fuse holder 42. It will be understood that fuse holder 44 is formed in the same manner as fuse holder 42. Fuse holder 42 has a fuse holding end 72 and a contact end 74. Fuse holding end 72 has two clips 76, 78 joined by a bridge 80. Each clip 76, 78, has a pair of stop tabs 82, 84.

Figure 7A:
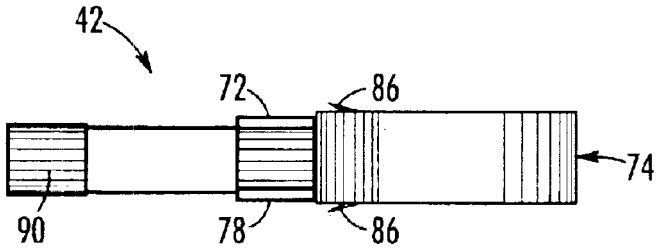
FIGS. 7A, 7B, and 7C are perspective views of the present fuse holder with fuses of different sizes (7A, B) and a buss bar (7C), according to a preferred embodiment of the present invention.
Figure 7B:
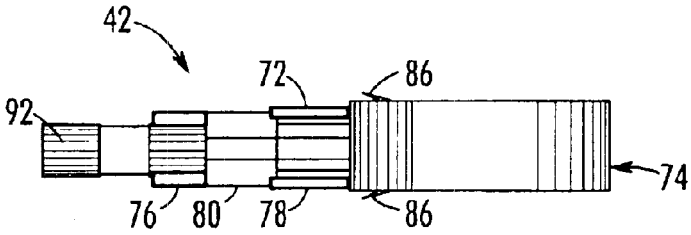

Fuse holder 42 can receive different types of fuses. Fuses of different types may come in different lengths; however, fuse holder 42 is designed to maintain the overall length of fuse-plus-fuse holder so that electrical contact is uninterrupted. For example, there is a 5 mm×20 mm fuse 90 (FIG. 7A) and a 3.5 mm×10 mm fuse 92 (FIG. 7B). For applications up to 15 amps, the longer fuse is appropriate; for applications requiring 3 amps or less, the smaller fuse is appropriate. Using the appropriate fuse can assure suitable circuit protection and can maintain low costs. If the longer fuse is selected, bridge 80 is broken and clip 76 discarded (or recycled by the manufacturer, but it is not needed to assemble the present receptacle with the longer fuse). The fuse is inserted in clip 78, as illustrated in FIG. 7A, until it reaches stop tabs 84. Then the fuse holder 42 can be inserted into fuse section 14.

If the shorter Fuse is selected, as illustrated in FIG. 7B, it is inserted into clip 76 until it reaches stop tabs 82. Then, the fuse and fuse holder 42 can be inserted into fuse section 14.

Contact end 74 of fuse holder 42 is generally "S" shaped in order to be in the path of prong 50 upon insertion and to be cammed into notch 64 by prong 50. Also, contact end 74 carries plural rearward-facing barbs 86 that prevent removal of fuse holder 42 from channel 60 but do not prevent its insertion.

Figure 7C:
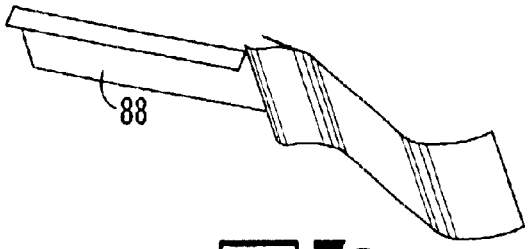

FIG. 7C illustrates a buss bar 88 being held in fuse holder 42. Buss bar 88 is simply a conductor of sufficient length to reach terminal 46.

It will be apparent to those skilled in the art of electrical appliance power supplies that many modifications and substitutions can be made to the foregoing preferred embodiments without departing from the spirit and scope of the present invention, defined by the appended claims.

What is claimed is:

1. An article for use with an electrical plug, said article comprising: a housing having a first end and an opposing second end, said first end having two holes formed therein and adapted for receiving prongs of an electrical plug, said second end having a cavity formed therein, and said housing further having channel means formed therein in communication with said two holes of said first end and said cavity of said second end; a pair of fuses carried in said channel means; a pair of wires received through said cavity and in electrical contact with said fuses; a pair of contacts carried in said channel means and in electrical connection with said fuses, said pair of contacts being proximate to said holes of said first section, whereby said pair of fuses, said pair of wires and said pair of contacts define a pair of electrical paths, each path of said pair of electrical paths including one wire of said pair of wires, one fuse of said pair of fuses, and one contact of said pair of contacts, said electrical paths being adapted to conduct electrical current from said pair of wires to said prongs of said electrical plug when said prongs are inserted into said holes and electrical current is being carried by said pair of wires, wherein said housing further comprises: a power section; a fuse section; and means for securing said power section to said fuse section, and said power section telescopes into said fuse section.

2. The article as recited in claim 1, further comprising means carried by said pair of contacts for holding said pair of fuses.

3. The article as recited in claim 2, wherein said holding means is adapted to hold fuses of different sizes.

4. The article as recited in claim 1, further comprising a locking lid, said locking lid being dimensioned to cover said cavity and hold said wires in place.

5. The article as recited in claim 1, wherein said first end has cutout portions formed therein dimensioned to receive said pair of wires.

6. The article as recited in claim 4, wherein said locking lid has cutout portions formed therein and said second end has cutout portions formed therein alignable with said cutout portions of said locking lid, said cutout portions of said locking lid and said second end being dimensioned to receive said pair of wires.

7. An article for use with an electrical plug, said article comprising: a housing having a first end and an opposing second end, said first end having two holes formed therein and adapted for receiving prongs of an electrical plug, said second end having a cavity formed therein, and said housing further having channel means formed therein in communication with said two holes of said first end and said cavity of said second end; a fuse carried in said channel means; a buss bar carried in said channel means; a pair of wires received through said cavity and in electrical contact with said fuses; a pair of contacts carried in said channel means and in electrical connection with said fuses, said pair of contacts being proximate to said holes of said first section, whereby said buss bar, said fuse, said pair of wires and said pair of contacts define a pair of electrical paths, said first electrical path of said pair of electrical paths including one wire of said pair of wires, said fuse and a first contact of said pair of contacts, said second electrical path of said pair of electrical paths including a second wire of said pair of wires, said buss bar, and said second contact of said pair of contacts, said pair of electrical paths adapted to conduct electrical current from said pair of wires to prongs of said electrical plug when said prongs are inserted into said holes and electrical current is being carried by said pair of wires.

8. An article for use with an electrical plug, comprising: a housing having a power section and a fuse section slidable with respect to said power section, said power section having channels formed therein and a cavity in communication with said channels, said fuse section having channels and two holes, said two holes being in communication with said channels, said two holes being adapted to receive prongs of an electrical plug; at least one fuse; two fuse holders, each fuse holder of said two fuse holders carried in said channels of said fuse section and having a contact end proximate to said holes in said fuse section so that, when prongs of an electrical plug are inserted in said holes, said contact end engages said prongs; and two electrical wires having two terminals thereon, each terminal of said two terminals being attached to each wire of said two wires, said wires being received in said cavity and extending into said channels of said power section, said terminals, said at least one fuse and said two fuse holders define at least one electrically conducting path for carrying electrical current from said two wires to said contact when said two electrical wires are carrying electrical current.

9. The article as recited in claim 8, wherein said each fuse holder of said two fuse holders is adapted to hold fuses of different sizes.

10. The article as recited in claim 9, wherein said fuse holder further comprises two clips in spaced relation.

11. The article as recited in claim 10, further comprising bridge means for holding said two clips in spaced relation.

12. The article as recited in claim 8, where said at least one fuse is one fuse and wherein said article further comprises a buss bar.

13. The article as recited in claim 8, wherein said channels of said fuse section electrically isolate said contacts.

14. The article as recited in claim 8, wherein said channels of said power section electrically isolate said terminals.

15. The article as recited in claim 8, wherein said at least one fuse is two fuses and wherein said channels of said fuse section and said power section electrically isolate said fuses.

16. The article as recited in claim 8, further comprising a locking lid, said locking lid being dimensioned to cover said cavity and hold said two electrical wires in place.

17. The article as recited in claim 16, wherein said locking lid has cutout portions formed therein and said second end has cutout portions formed therein registerable with said cutout portions of said locking lid, said cutout portions of said locking lid and said second end being dimensioned to receive said two electrical wires.

18. An article for use with an electrical plug, said article comprising:

a housing having a first end and an opposing second end, said first end having two holes formed therein and adapted for receiving prongs of an electrical plug, said second end having a cavity formed therein, and said housing further having channel means formed therein in communication with said two holes of said first end and said cavity of said second end;

a pair of fuses carried in said channel means; a pair of wires received through said cavity and in electrical contact with said fuses;

a pair of contacts carried in said channel means and in electrical connection with said fuses, said pair of contacts being proximate to said holes of said first section, whereby said pair of fuses, said pair of wires and said pair of contacts define a pair of electrical paths, each path of said pair of electrical paths including one wire of said pair of wires, one fuse of said pair of fuses, and one contact of said pair of contacts, said electrical paths being adapted to conduct electrical current from said pair of wires to said prongs of said electrical plug when said prongs are inserted into said holes and electrical current is being carried by said pair of wires; and a locking lid, said locking lid being dimensioned to cover said cavity and hold said two electrical wires in place, wherein said locking lid has cutout portions formed therein and said second end has cutout portions formed therein registerable with said cutout portions of said locking lid, said cutout portions of said locking lid and said second end being dimensioned to receive said two electrical wires.

* * * * *